US006737004B2

(12) United States Patent
Wang et al.

(10) Patent No.: US 6,737,004 B2
(45) Date of Patent: May 18, 2004

(54) PROCESS OF MAKING SPLITTABLE MICROFIBER SUBSTRATE

(75) Inventors: Ching-Tang Wang, Taipei (TW); Mong-Ching Lin, Kaohsiung (TW); Kuo-Kuang Cheng, Kaohsiung Hsien (TW); Chin-Yi Lin, Kaohsiung (TW)

(73) Assignee: San Fang Chemical Industry Co. Ltd., Kaohsiung Hsien (TW)

( * ) Notice: Subject to any disclaimer, the term of this patent is extended or adjusted under 35 U.S.C. 154(b) by 295 days.

(21) Appl. No.: 09/917,946

(22) Filed: Jul. 31, 2001

(65) Prior Publication Data

US 2003/0034584 A1 Feb. 20, 2003

(51) Int. Cl.[7] ..... D01D 5/26; D01D 5/32; D01D 5/34; D01G 1/00; D04B 35/00

(52) U.S. Cl. ..... 264/103; 19/0.35; 19/98; 28/100; 66/1 R; 264/143; 264/172.4; 264/172.15; 264/210.8; 264/211.14; 264/211.2

(58) Field of Search ..... 264/103, 172.14, 264/172.15, 210.8, 211.14, 211.2, 143; 19/0.35, 98; 28/100; 66/1 R

(56) References Cited

FOREIGN PATENT DOCUMENTS

WO WO-0111124 A1 * 2/2001

* cited by examiner

*Primary Examiner*—Leo B. Tentoni
(74) *Attorney, Agent, or Firm*—Bacon & Thomas

(57) ABSTRACT

A microfiber substrate of improved carding ability and its manufacturing method, and more particularly a micro-fiber spun by conjugated melting of crystallization difference of high crystallization polymer and low crystallization polyester, drawn to form an unsplit microfiber staple having a layer of thin film in its surrounding, the microfiber staple which is still kept in unsplitting state during opening, carding and lapping treatment, will be split just at the layer of thin layer of its surrounding of the microfiber staple by spunlace to completely split from the microfiber, knitted to form water-jet punch web, then subject to hot water to shrink to densification. The microfiber nonwoven web excellent in the wiping effect, cleaning effect and microfiber artificial leather excellent in the hand feeling and fluff compaction without environment pollution is enabled to offer the artificial leather more cheaply and easily finished.

7 Claims, 2 Drawing Sheets

PROCESS OF MAKING SPLITTABLE MICROFIBER SUBSTRATE

FIELD OF THE INVENTION

This invention relates generally to a microfiber substrate of improved carding ability and its manufacturing method, and more particularly to a micro-fiber spun by conjugated melting of crystallization difference of high crystallization polymer and low crystallization polyester, drawn to form an unsplit microfiber staple having a layer of thin film in its surrounding, the said microfiber staple which is still kept in unsplitting state during opening, carding and lapping treatment, will be split just at the layer of thin layer of its surrounding of the said microfiber staple by spunlace to completely split from the said microfiber, knitted to form water-jet punch web, then subject to hot water to shrink to densification.

PRIOR ART

It is well known that a manufacturing method of suede tone or nubuck tone microfiber web as described in the Japan Laid-Open Patent Application No. 1972-030930 is typical of many of the patents of the prior art, which discloses filaments through conjugate melt by adopting polyester and polyamide in the adjacent spinnerettes are adhered with nonaqueous spinning finishing agent and then aqueous spinning finishing agent, and then the web formed after splitting is subjected to boiling water to split into each component. By using this method, the conjugate filaments will likely to split into each component during drawing and fracture of monofilament will be occurred, this is not suitable for finishing.

Japan Laid-Open Patent Application No. 1976-070366 discloses a manufacturing method of suede tone or nubuck tone microfiber web involving to filaments through conjugate melt by adopting polyester containing 0.05~1.0 mole % sulfonated metal salt and polyamide in the adjacent spinnerettes and along the tangential direction to the filaments in alternatively located way to obtain hollow ring shape conjugated filaments. After these hollow ring shape conjugated filaments are crimped in the web, dips into warm water that make the shrinkage rate of the conjugated fiber below 10%, bends the web to split into monofilament of each component, and to get a suede tone or nubuck tone microfiber web. By using this method, the conjugate filament will likely to split into each component during drawing and fracture of monofilament will be occurred, this is not suitable for finishing.

PROBLEM TO BE SOLVED

From environmental protection standpoint, conventional microfiber is usually manufactured by splitting the filaments, which is spun by adopting splitting type spinnerette, and directly using mechanical means such as spunlace, abrasion, flexing etc., (refer to Japan Laid-Open Patent Application No. 1981-154546, applicant: Kanebo Corporation, Japan), or by using heat treatment means such as hot water, hot air etc., (refer to Japan Laid-Open Patent Application No. 1976-70366, applicant: Teijin Corporation, Japan) to obtain microfiber.

The two component conjugated filament shown in FIG. 2*a* (FIG. 1 of Japan Laid-Open Patent Application No. 1981-154546) and FIG. 2*b* (FIG. 2 of Japan Laid-Open Patent Application No. 1976-70366), which is extruded by extruding different component polymers through different spinnerette. The two different component polymers are merely separated by mechanical means or heat treatment to split into microfiber. But this is not suitable due to high cost and high precision equipment involved to this process.

It is apparent that the split section of monofilament as shown in FIGS. 2*a* and 2*b* are completely hollow in the surrounding of the two component conjugated filament. The inclined line portion of the monofilament is supposed as A component, while the bold line in FIG. 2*a* and the blank portion in FIG. 2*b* is supposed as B component. When the difference of crystallization degree between these two components A and B is too large, the filament obtained apt to split during drawing, opening and carding, it is not suitable for processing and after finishing. To avoid the early splitting, polymer of these two components A and B having approximate crystallization degree is adopted, but bad splitting often occurred in the splitting process and microfiber is not obtained.

Low crystallization degree polymer may be used to obtain filament with shrinkage, but this will cause the filament split too early. How to get a two component conjugated filament with easily split and shrinkable effect is a long-felt subject matter to the person skilled in the art.

In viewing of the above faults, the inventors have studied many polymers of different crystallization degree suitable for spinning into conjugated filament, and discover that polymer of high crystallization degree and polyester of low crystallization degree can be used to spin by conjugated spinning, drawn to form an unsplit microfiber staple having a layer of thin film in its surrounding, the said microfiber staple which is still kept in unsplitting state during opening, carding and lapping treatment, will be split just at the layer of thin layer of its surrounding of the said microfiber staple by spunlace to completely split from the said microfiber, knitted to form water-jet punch web, then subject to hot water to shrink to densification to obtain microfiber substrate. The microfiber substrate of this invention can be obtained by using spunlace, then treated by hot water or hot air shrinking treatment without using solvent, alkali solution. Mechanically physical means and mechanically impingement means and heat treatment used in the splitting of the said microfiber substrate meets the requirement of environmental protection regulation.

SUMMARY OF THE INVENTION

It is the object of this invention to provide a microfiber substrate of improved carding ability and its manufacturing method, and more particularly to a microfiber spun by conjugated melting of crystallization difference of high crystallization degree polymer and low crystallization degree polyester, drawn to form an unsplit micro-fiber staple having a layer of thin film in its surrounding, the said micro-fiber staple which is still kept in unsplitting state during opening, carding and lapping treatment, will be split just at the layer of thin layer of its surrounding of the said microfiber staple by spunlace to completely split to get the said microfiber, excellent in carding ability, softness, hand, knitted to form spunlace web, then subject to hot water to shrink to densification.

MEANS FOR SOLVING THE PROBLEM

The spunlace splittable microfiber substrate of this invention which attains the above-mentioned purpose, which is characterized by extruding polymer chip containing high crystallization degree polymer (A) and low crystallization degree polyester (B) in the weight ratio of 5/195~95/5 used for conjugated melting to spin into filament, when the cross section of the orientation of the diameter of the filament is taken, by using the layout of spinnerette to spin the filament which having high crystallization degree polymer (A) surrounded by low crystallization degree polyester(B). (1) The aforementioned high crystallization degree polymer (A) region is distributed so that the main segment of the configuration which has two or more branching sections which were formed in the fiber center section, and which collected and were extended from the section to the radial toward the fiber front face may be formed. (2) The aforementioned low crystallization degree polyester (B)is distributed in the thin film shape so that it can surround the aforementioned high crystallization degree polymer (A) which extended from the section to the radial toward the fiber front face. (3)The ratio of the thickness of the thin film to the diameter Y of microfiber which have not spunlaced and split is taken as Z in percentage, indicated in term of the diameter Y of microfiber which have not spunlaced and split and the diameter X of microfiber which have spunlaced and split as the relation: $Z=(1-X/Y)/2\times100\%$, $0.1\%\leqq Z\leqq 5.0\%$. The microfiber so obtained is not spunlaced and split (the cross-section of the said unspunlaced and unsplit microfiber is shown as FIG. 1A), then is subject to draw, cut to form an unsplit microfiber staple having a layer of thin film in its surrounding, succeeded by opening, carding and lapping treatment, is knitted to form spunlace web (the cross-section of the spunlaced and split microfiber is shown as FIG. 1B), then is treated by hot water, hot air to shrink to densification.

The spun microfiber obtained before spunlace (water-jet punching) treatment is subject to drawing to get microfiber staple of fineness 1.0~6.0 denier, then lapping, water-jet punching to split into 4–108 segments to get fineness 0.001~0.8 denier.

EMBODIMENTS OF THE INVENTION

Figure 1A:
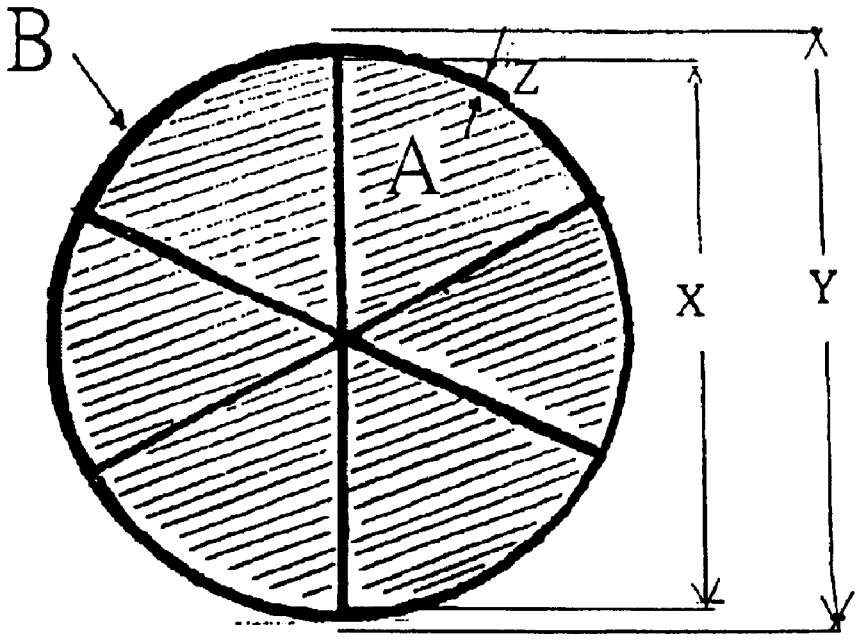
FIG. 1A illustrates an example of the cross-section configuration of the unsplit microfiber of this invention.

Hereafter, the gestalt of operation of this invention is explained in details. The spunlace splittable microfiber of this invention, as mentioned above, comprises high crystallization degree polymer (A) and low crystallization degree polyester (B) as its raw material. As a typical example of above-mentioned high crystallization degree polymer (A), Nylon 6, Nylon 66, polyethylene terephthalate (PET), polypropylene terephthalate (PPT), polybutylene terephthalate (PBT), polypropylene (PP), thermoplastic polyurethane (TPU) of crystallization degree over 25% are preferably used. As a typical example of above-mentioned low crystallization degree polyester (B), such as polyester of crystallization degree below 25% are preferably used, it can be obtained from the esterification product of one and more than one glycolic acid selected from the group of oxalic acid, succinic acid, o-phthalic acid, m-phthalic acid, p-hydroxybenzoic acid, p-hydroxy ethyl benzoic acid, and sodium m-phthalic acid sulfonate and one and more than one glycol selected from the group of 1,3-propylene glycol, 1,4-butylene glycol, diethylene glycol, polyethylene glycol, cyclohexyl dimethanol and terephthalyl alcohol.

By extruding polymer chip containing high crystallization degree polymer (A) and low crystallization degree polyester (B) in the weight ratio of 5/95~95/5 used for conjugated melting to spin into filament, when the cross section of the orientation of the diameter of the filament is taken, by spinning the filament which having high crystallization degree polymer (A) surrounded by low crystallization degree polyester (B). The aforementioned high crystallization degree polymer (A) region is distributed so that the main segment of the configuration which has two or more branching sections which were formed in the fiber center section, and which collected and were extended from the section to the radial toward the fiber front face may be formed. The said cross section of the orientation of the diameter of the filament taken means there is a substantially similar relation between the section shape of radial direction of undrawn filament and drawn filament. The aforementioned high crystallization degree polymer (A) region is distributed so that the main segment of the configuration which has two or more branching sections were formed in the fiber center section can be obtained by using the spunlace splittable microfiber of this invention to get microfiber staple to allow carding undergoes, the main segment of the configuration which has two or more branching sections of the aforementioned high crystallization degree polymer (A) will not narrowed due to the said main segment of the configuration are entangled each other. While the said main segment of the configuration of the aforementioned high crystallization degree polymer (A) works in coordination with the aforementioned low crystallization degree polyester (B) which distributed in the thin film shape surrounding the aforementioned high crystallization degree polymer (A), so it can be split when it is subjected to spunlace splitting treatment.

The total number of the main segment of the configuration having more than two branching sections of the aforementioned high crystallization degree polymer (A) is preferably greater than 4, but for the sake of obtaining microfiber artificial leather excellent in fluff compaction and hand touch feeling, it is preferably to divide into 4~108 segments. The total number of the aforementioned low crystallization degree polyester (B) which distributed in the thin film shape surrounding the aforementioned high crystallization degree polymer (A) is two times of the total number of the main segment of the configuration having more than two branching sections of the aforementioned high crystallization degree polymer (A) in the range of 8~216.

Figure 1B:
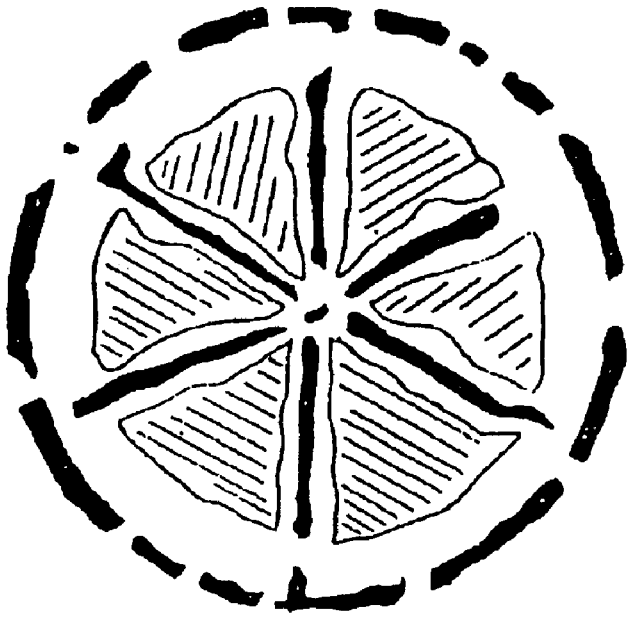
FIG. 1B illustrates an example of the cross-section configuration of the spunlaced and split microfiber of this invention.
Figure 2A:
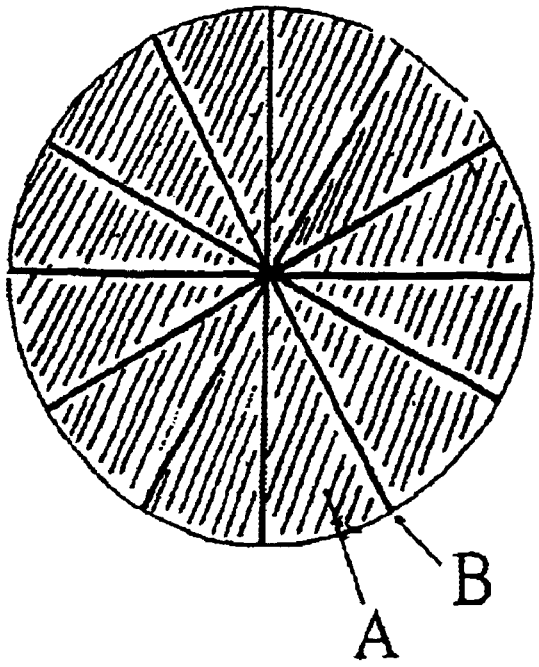
FIG 2A (PRIOR ART)
FIG. 2A illustrates an example of the cross-section configuration of the microfiber obtained from conventional bicomponent conjugated filament.
Figure 2B:
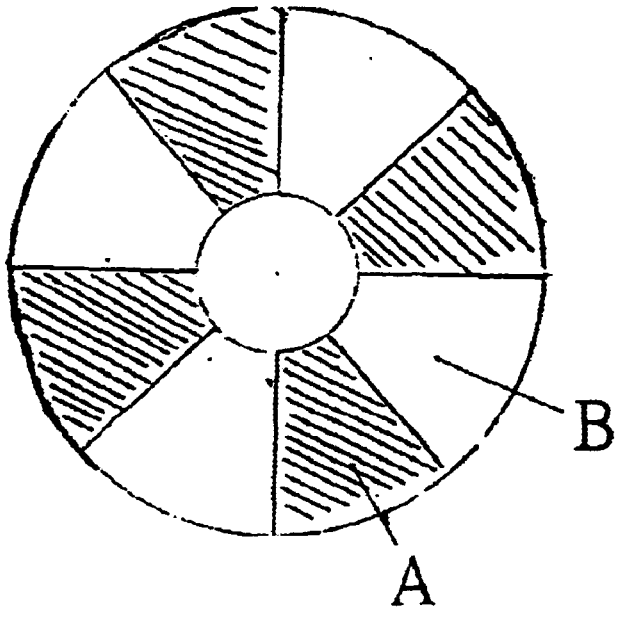
FIG 2B (PRIOR ART)
FIG. 2B illustrates other example of the cross-section configuration of the microfiber obtained from conventional two- components conjugated filament.

(3) The ratio of the thickness of the thin film of the aforementioned low crystallization degree polyester (B) distributed to surround the aforementioned high crystallization degree polymer (A) to the diameter Y of microfiber which have not spunlaced and split is taken as Z in percentage, indicated in term of the diameter Y of microfiber which have not spunlaced and split and the diameter X of microfiber which have spunlaced and split as the relation: $Z=(1-X/Y)/2\times100\%$, is preferably fell in the range of 0.1% and 5.0%. When Z is smaller than 0.1%, the thin film is apt to fracture in the drawing, opening and carding process, thus the microfiber will split earlier than processing. When Z is greater than 5%, the thin film is not easily to fracture and not easily split. The unspunlaced and unsplit filament so obtained is then subject to draw, form an unsplit staple having fineness of 1.0~6.0 denier, succeeded by opening, carding and lapping treatment, to allow the staple web to entangle each other by using water-jet punching of water pressure 10~600 bar, at the same time the thin film is completely peeled off from the surrounding of the staple and split into microfiber (the cross-section of the spunlaced and split microfiber is shown as FIG. 1B) with fineness of 0.01~0.5 dpf (denier per filament), the said obtained microfiber is knitted to form spunlace nonwoven, then the spunlaced nonwoven is treated by 60~98° C. hot water or 100~200° C. hot air to shrink to allow the area of the spunlaced nonwoven shrink 5~30% and densify to get a microfiber substrate excellent in hand feeling and flexibility.

The nonwoven which has been shrunk can be dipped into waterborne polyurethane resin solution, waterborne polyacrylate solution, then undergoes drying, polishing, dyeing, or laminating with skin to get microfiber artificial leather. Also the nonwoven which has been shrunk can be dipped into waterborne polyurethane resin solution, waterborne polyacrylate solution, then undergoes drying, polishing to get microfiber wiping cloth excellent in fluff compaction.

EMBODIMENT EXAMPLE

Extruding polymer chip prepared from polyamide polymer (Nylon 6 in trademark as Ultramid by BASF, Gmbh, Germany) and polyethylene terephthalate containing 5 mole % of isophthalic acid in the weight ratio of 80/20 in conjugated melting to spin into filament. The temperature of melt polymer in the spinning head is set at 285° C., the winding speed is set at 1200 m/min, to get undrawn filament having fineness of 10 dpf, tenacity of 1.5 g/den, elongation rate of 500%. The undrawn filament obtained is subjected to condition of temperature 70° C., drawing rate of 300% to draw, then drying and cutting to get microfiber staple having fineness of 3.5 dpf, tenacity of 4 g/den, elongation rate of 80%, length of 64 mm.

The microfiber staple so obtained is then subject to opening, carding and lapping treatment, to allow the staple web to wet first by using water-jet punching of water pressure 10 bar, then by using four water-jet punching of water pressure 200 bar, 300 bar, 350 bar, and 350 bar separately to entangle each other, at the same time the thin film is completely peeled off from the surrounding of the staple and split into microfiber. Water-jet punching of water pressure 200 bar in turbulent flow is used to finish the surface of the staple web to get microfiber nonwoven with weight per unit area of 300 g/m$^2$, fineness of 0.01~0.5 dpf. The physical properties of the microfiber nonwoven is shown in the Table 1. Then the spunlaced nonwoven is treated by 90° C. hot water to shrink, then dipped into waterborne polyurethane resin solution, subjected to drying, polishing, dyeing to get microfiber artificial leather.

TABLE 1 physical properties of the microfiber nonwoven of this invention

| Test items | Data |
|---|---|
| Weight per unit area (ASTM D3776) | 300 g/m$^2$ |
| Thickness (ASTM D2262) | 1.2 mm |
| Tearing strength (longitudinal direction (ASTM D2262) | 9.14 kgf |
| Tearing strength (transverse direction) (ASTM D2262) | 8.99 kgf |
| Tensile strength (longitudinal direction) (ASTM D2262) | 33.58 kgf/cm |

TABLE 1-continued physical properties of the microfiber nonwoven of this invention

| Test items | Data |
|---|---|
| Tensile strength (transverse direction) (ASTM D2262) | 17.13 kgf/cm |
| Elongation (longitudinal direction) | 70% |
| Elongation (transverse direction) | 90% |
| Breaking strength | 30 kgf |

Effect of this Invention

Since it becomes easy to obtain the microfiber nonwoven web excellent in the wiping effect, cleaning effect and microfiber artificial leather excellent in the hand feeling and fluff compaction without environment pollution according to this invention as explained above, it is enabled to offer the artificial leather more cheaply and easily finished.

What is claimed is:

1. A manufacturing method of splittable microfiber substrate, which comprises:

(a) extruding polymer chip containing high crystallization degree polymer (A) and low crystallization degree polyester (B) in the weight ratio of 5/95~95/5 used for conjugated melting to spin into filament, when the cross section of the orientation of the diameter of the filament is taken, by using the layout of spinnerette to spin the filament which having high crystallization degree polymer (A) surrounded by low crystallization degree polyester (B); the said high crystallization degree polymer (A) region is distributed so that the main segment of the configuration which has two or more branching sections were formed in the fiber center section, and which collected and were extended from the section to the radial toward the fiber front face may be formed; the said low crystallization degree polyester (B) is distributed in the thin film shape so that it can surround the aforementioned high crystallization degree polymer (A) which extended from the section to the radial toward the fiber front face ; the ratio of the thickness of the thin film to the diameter Y of microfiber which have not spunlaced and split is taken as Z in percentage, indicated in term of the diameter Y of microfiber which have not spunlaced and split and the diameter X of microfiber which have spun-laced and split as the relation:

$$Z=(1-X(Y)/2\times 100\%,\ 0.1\% \leqq Z \leqq 5.0\%$$

(b) drawing the said unspunlaced and unsplit microfiber filament to form an unsplit microfiber staple, succeeded by opening, carding, lapping and water-jet punching treatment, knitting to form spunlace web, then treating by hot water, hot air to shrink to densification and get a microfiber substrate of improved carding ability.

2. The manufacturing method according to claim 1, wherein said high crystallization degree polymer (A) can be one or more than one selected from the group consisting of Nylon 6, Nylon 66 , polyethylene terephthalate (PET), polypropylene terephthalate (PPT), polybutylene terephthalate (PBT), polypropylene (PP) and thermoplastic polyurethane (TPU) of crystallization degree over 25%.

3. The manufacturing method according to claim 1, wherein said low crystallization degree polyester (B) can be one or more than one polyester (B) having low crystallization degree below 25% which can be obtained from the esterification product of one or more than one glycolic acid selected from the group consisting of oxalic acid, succinic acid, o-phthalic acid, m-phthalic acid, p-hydroxybenzoic acid, p-hydroxy ethyl benzoic acid, and sodium m-phthalic acid sulfonate and one or more than one glycol selected from the group consisting of 1,3-propylene glycol, 1,4-butylene glycol, diethylene glycol, polyethylene glycol, cyclohexyl dimethanol and terephthalyl alcohol.

4. The manufacturing method according to claim 1, wherein said unspunlaced and unsplit microfiber filament will be divided into 4~108 segments while it is subjected to water-jet punching treatment to get microfiber of fineness 0.001–0.8 denier.

5. The manufacturing method according to claim 1, wherein the water pressure of the said water-jet punching treatment is in the range of 10–600 bar.

6. The manufacturing method according to claim 1, wherein the temperature of the said hot water is in the range of 50–98° C.

7. The manufacturing method according to claim 1, wherein the temperature of the said hot air is in the range of 100–200° C.

* * * * *